United States Patent [19]

Dörflinger et al.

[11] 3,979,900

[45] Sept. 14, 1976

[54] DEVICE FOR CONNECTING TWO PARTS OF A CLOCK

[75] Inventors: Helmut Dörflinger; Erich Ropertz, both of Niedereschach; Bruno Ruf, Obereschach, all of Germany

[73] Assignee: Adolf Jerger KG, Niedereschach, Germany

[22] Filed: Feb. 24, 1975

[21] Appl. No.: 552,491

[30] Foreign Application Priority Data

Feb. 28, 1974 Germany ..... 747049[U]
Mar. 14, 1974 Germany ..... 748983[U]

[52] U.S. Cl. ..... 58/52 R; 58/56; 29/177; 29/453

[51] Int. Cl.[2] ..... G04B 29/00

[58] Field of Search ..... 29/453, 177, 179; 58/23 R, 52 R, 53, 55, 56, 88 G

[56] References Cited

UNITED STATES PATENTS

| | | | |
|---|---|---|---|
| 2,229,021 | 1/1941 | Martin | 58/52 R |
| 2,230,916 | 2/1941 | Tinnermann | 29/453 |
| 2,337,239 | 12/1943 | Hall | 29/453 |
| 2,700,272 | 1/1955 | Trichel | 58/56 |
| 2,979,119 | 4/1961 | Kramer | 29/453 |
| 3,285,428 | 11/1966 | Scheck | 29/453 |
| 3,845,614 | 11/1974 | Christ | 58/53 |

FOREIGN PATENTS OR APPLICATIONS

| | | | |
|---|---|---|---|
| 1,466,310 | 12/1966 | France | 58/23 |

*Primary Examiner*—L. T. Hix
*Assistant Examiner*—Vit W. Miska
*Attorney, Agent, or Firm*—W. G. Fasse; W. W. Roberts

[57] ABSTRACT

A device for connecting two parts of a clock in which one part is provided with an opening and the other with a projecting element. There is a resilient region on one side of the opening and a latch projection on the projecting element. The resilient side of the opening is deflected by the projecting element until the latch projection engages the first mentioned part and the resilient side catches the latch projection.

16 Claims, 14 Drawing Figures

DEVICE FOR CONNECTING TWO PARTS OF A CLOCK

BACKGROUND OF THE INVENTION

The present invention relates to clocks having parts which are connected by retaining means in which the first part has an opening to accept a projection of the second part.

The two parts to be connected are for instance the baseplate and a bedplate or a bedplate and the bell of an alarm clock. It is also possible to mount a figurine on the casing of an alarm clock in this manner.

As disclosed in DT-OS 1 673 653 it is known in the art to rigidly mount support posts to the baseplate by rivetting, these support posts having annular grooves. These grooves are aligned with a wedgelike slot in the second part and moved to its narrowing end thereby forming a wedging engagement between the two parts. A retaining lug is provided at this end which is deflected sidewardly in the plane of the baseplate by movement of the support post and which engages this post in its position.

This kind of mounting requires support posts having annular grooves which must be fixed to the baseplate by rivetting or similar methods. Also the bedplate is substantially weakened by forming the deflectable lug. The other parts as mentioned above are assembled using rivets or screws.

OBJECTS OF THE INVENTION

It is an object of the invention to overcome the above stated drawbacks of the prior art.

It is also an object of the present invention to provide an improved clock in which baseplate and bedplate are connected without using support posts and without weakening one of these parts in the aforementioned manner.

It is also an object of the invention to provide a clock on which figurines can be mounted without the use of screws or rivets.

Still another object of the invention is to provide an alarm clock on which the bell can be mounted without the use of screws.

Further objects and advantages of the present invention will become apparent as the following description proceeds.

SUMMARY OF THE INVENTION

Briefly stated, in accordance with the invention, the above objectives are achieved by providing a device in which a first part has an opening which is provided with a resilient region on one side and the other part is provided with a projecting element aligned with the opening in the first part. This projecting element is provided with a latch projection. The resilient side of the opening in the first part is bent out of its normal position by the projecting element until the latch projection engages the first part and the resilient region moves back in its original position thereby retaining the projecting element.

BRIEF FIGURE DESCRIPTION

In order that the invention may be more clearly understood, some embodiments will now be described with reference to the accompanying drawings, in which.

DETAILED DESCRIPTION OF EXAMPLE EMBODIMENTS

Figure 1:
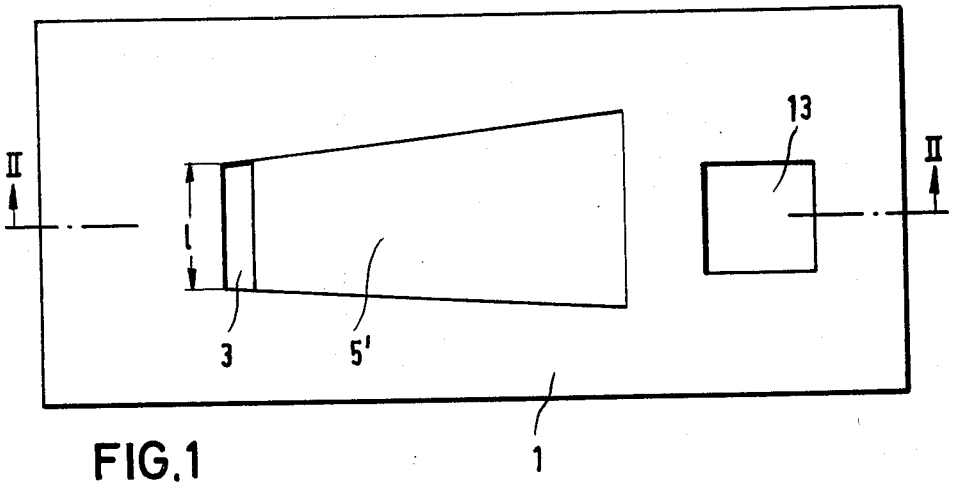
FIG. 1 is a front view of the opening in one part showning the resilient side of the opening.

Referring now to the drawings, the principle of the invention is to be described using two parts of an alarm clock.

Figure 2:
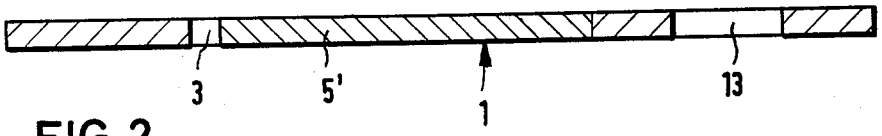
FIG. 2 is a sectional side view taken on line II—II of FIG. 1.

In FIG. 1 there is illustrated a first part 1 which is to be connected with a second part. It is provided with a opening 3 having an adjacent resilient region 5'. The material of the region 5' may be bent out of the plane of part 1 by applying pressure, but it will return in its former position when no more pressure is applied. The same features are depicted in the sectional view of FIG. 2.

Figure 3:
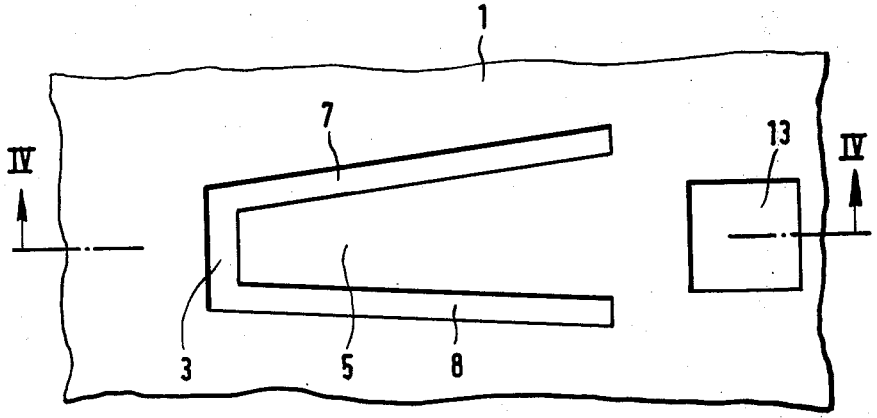
FIG. 3 is a front view of another embodiment of the invention.

FIG. 3 shows an embodiment in which the resilient region is formed by stamping out slits 7 and 8 simultaneously with stamping out the opening 3 thereby forming a sheared out leg 5. The end of the leg 5 is also the rim of the opening 3.

Figure 4:
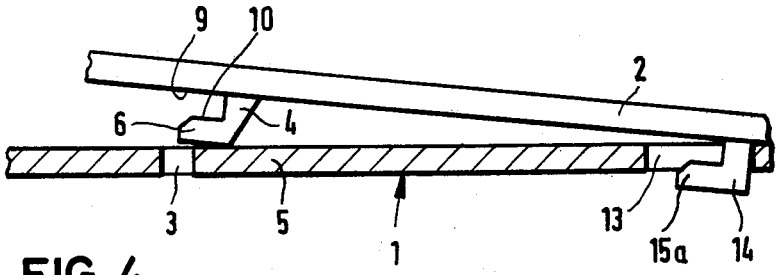
FIG. 4 is a sectional view taken on line IV—IV of FIG. 3 of the two parts to be connected prior to their connection.

The second part 2 which is shown in FIG. 4 is provided with a projecting element 4 which has a latch projection 6 forming a L-shaped hook.

In the position shown in FIGS. 4 to 7 the two parts 1 and 2 are to be connected contacting each other. For this reason the gap between the lower side 9 of the second part 2 facing the first part 1 and the upper side 10 of the latch projection is chosen like the thickness of the first part 1.

The maximum width of the projecting element 4 is the same as the width of the opening 3. In the embodiment shown in FIGS. 4 to 7 the rear side of the element 4 facing the resilient region 5 is tapered.

Figure 5:
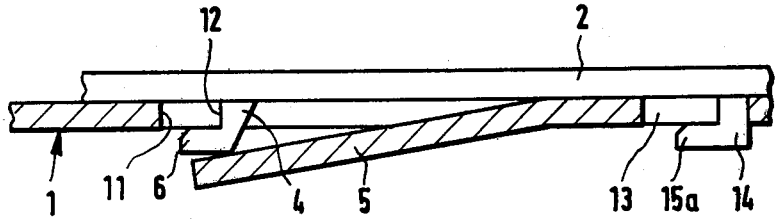
FIG. 5 is a view similar to FIG. 4 but after the first step in order to connect the two parts.

The open side of the hook formed by the element 4 and the latch projection 6 is facing the side 11 of the opening 3 opposite the resilient region 5. The latch projection 6 is longer than the width of the opening 3 in this direction. To connect the parts 1 and 2 the projecting element 4 is aligned with the resilient leg as shown in FIG. 4. By applying pressure to the leg 5 it is deflected out of the plane of part 1, as is shown in FIG. 5. Then part 2 is pushed towards side 11 of the opening 3 opposite the resilient side.

Figure 6:
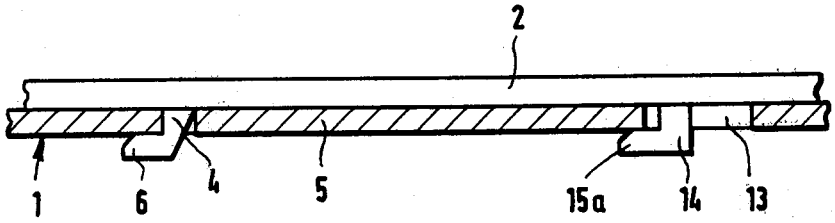
FIG. 6 is a view similar to FIG. 4 and 5 after completed connection of the two parts.

When the front side 12 of element 4 touches the side 11 of opening 3 the leg 5 returns in its initial position thereby catching and retaining the element 4 as shown in FIG. 6. In this way the parts 1 and 2 are firmly connected. The tapered side of the element 4 makes it possible for the leg 5 to catch this element before side 12 hits side 11 of the opening 3. In this way the elasticity of the leg 5 aids in pushing part 2 against the stop formed by side 11.

Figure 7:
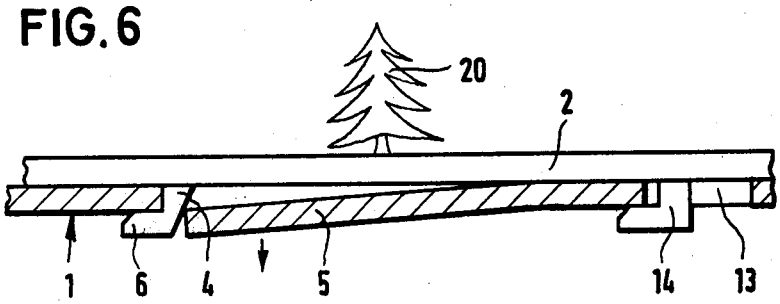
FIG. 7 is another embodiment of the connection.

In the embodiment shown in FIG. 7 the resilient leg 5 is slightly longer than in the embodiment of FIGS. 4 to 6, that is the width of the opening 3 is slightly narrower than the width of the element 4 at its base.

Therefore the leg 5 cannot return to its original position when side 12 is stopped by side 11, but it remains in a slightly deflected state. This embodiment is especially adventageous if the connection between the parts 1 and 2 is to be demountable easily. Using a hook shaped tool the leg 5 may be deflected in the direction of the arrow shown in FIG. 7 thereby disengaging element 4 and part 1.

According to a special embodiment the width of the element 4 perpendicular to the plane of the drawing matches the width 1 (FIG. 1) of the opening 3. In this way torsional rigidity of the parts 1 and 2 shown in FIGS. 6 and 7 is achieved.

According to another embodiment shown also in FIGS. 1 to 7 the first part 1 may be provided with another opening 13 and the second part 2 with another hook shaped element 14. The openings 3 and 13 and the elements 4 and 14 are aligned with each other respectively. When the element 4 is placed on the resilient leg 5 the element 14 is inserted into the opening 13.

The gap between the lower side 9 of part 2 and the upper side of the latch projection 15*a* is again equal to the thickness of part 1. The length of the latch projection 15*a* is chosen so as to engage the lower side of part 1 when part 2 is moved to the position where the leg 5 catches the element 4. The open sides of both hooks 14 and 4 are pointing to the same direction.

It is practical to form both hooks by stamping and bending integrally from part 2 itself.

According to an embodiment of the invention figurines may be mounted on the casing of an alarm clock using the principle of the invention. In this case part 1 represents the casing and part 2 the base of the figurine 20, as shown in FIG. 7. By using the present invention the connection between figurine 20 and casing may be accomplished without the use of tools by placing the figurine on the resilient leg and exerting a relative motion between the part 1 and 2. No auxiliary device is necessary and a rigid mount is achieved which cannot be opened inadvertently.

In case parts 1 and 2 are to be connected leaving a gap between the two the length of the elements carrying the latch projection is chosen according to this gap. Part of these elements then serve as support for the nonresilient sides of the openings 3 and 13.

Figure 8:
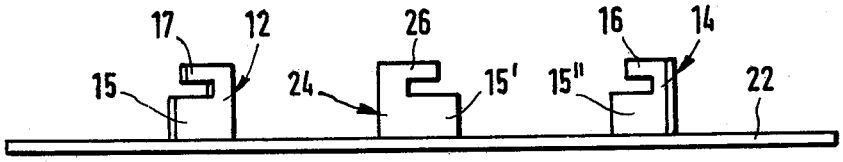
FIG. 8 is a side view of a baseplate showning projecting elements according to the invention.
Figure 9:
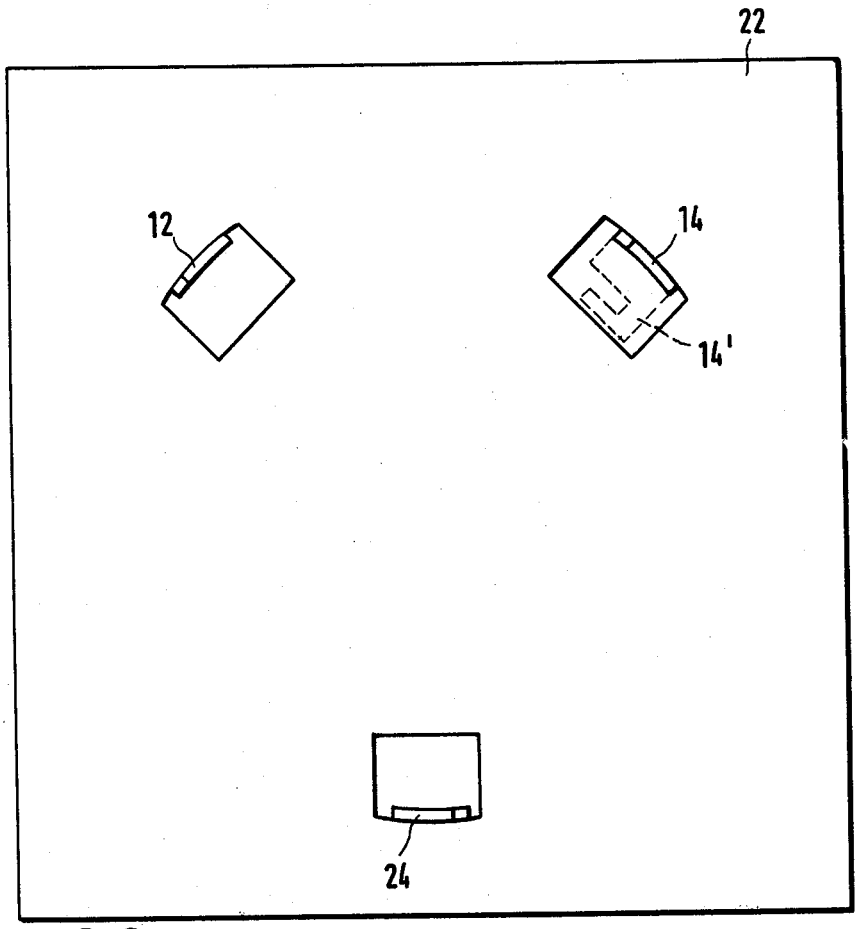
FIG. 9 is a front view of the baseplate shown in FIG. 8.
Figure 10:
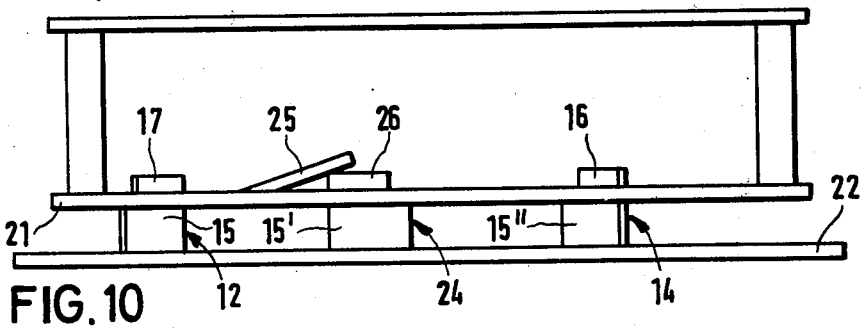
FIG. 10 is a side view of the bedplate to be connected with the baseplate prior to their connection.

FIGS. 8 to 10 show an embodiment of this type in which the present invention is applied to the connection of a baseplate 22 to an inner bedplate 21.

The baseplate 22 is manufactured by stamping out the elements 24, 12 and 14 shown by dashed lines as 14′ and bending them into the form shown in FIG. 8. The inner bedplate 21 which is to be connected to the baseplate 22 is provided with an opening 3 and an adjacent resilient region 25 as explained and illustrated in FIGS. 1 to 7.

Two more openings are provided in the baseplate 22 in which the elements 12 and 14 are inserted when the element 24 is placed on the resilient leg of the opening 3. The latch projections 16, 17 and 26 will engage the lower side of the bedplate 21 when the the baseplate 22 is rotated and the leg 25 will catch the latch projection 26. The openings of the hook shaped elements 24, 12 and 14 point to the same circular direction. FIG. 10 shows the baseplate 22 mounted on the bedplate 21 according to a position shown in FIG. 5. A subsequent rotation of part 21 or 22 will bring the latch projection 26 in a position where it is caught by the leg 25.

The elements 24, 12 and 14 are provided with spacing extensions 15, 15′ and 15″ on which the nonresilient sides of the openings of the bedplate 21 rest thereby providing a gap between bedplate 21 and baseplate 22.

Baseplate and bedplate may be manufactured using plastic material thereby avoiding additional stamping and bending operations.

As shown in FIGS. 11 to 14 it is contemplated in one embodiment of the invention that a bell 31 is to be connected with the rear bedplate 32 according to the principle shown in FIGS. 1 to 7. The function of the bedplate 32 corresponds to the function of part 1 and the bell to part 2 of FIGS. 1 to 7.

The rear bedplate 32 is provided with an opening 33 which corresponds to the opening 3 of FIG. 3. A resilient leg 34 is provided adjacent to the opening 33 and two more openings 35 and 36 aligned with the opening 33 and corresponding to the opening 13 in FIGS. 1 to 7.

Figure 11:
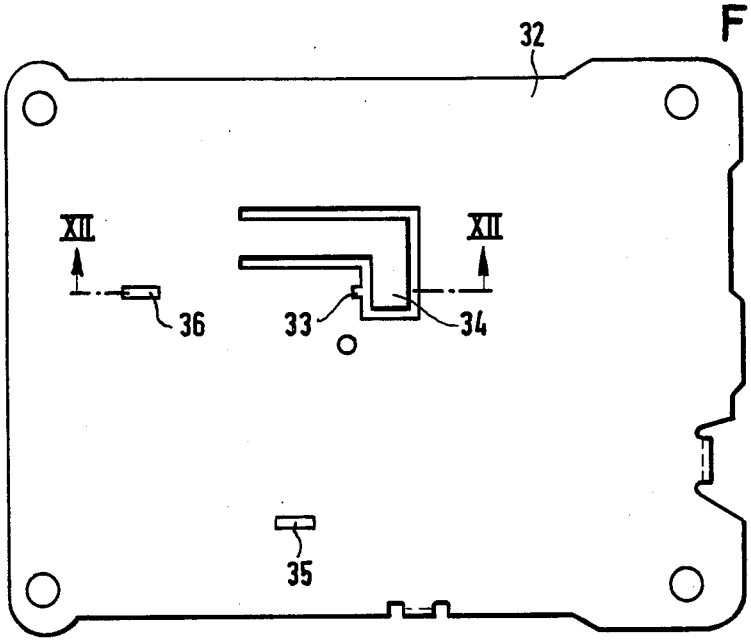
FIG. 11 is a front view of a rear bedplate which is to be connected with the bell.

As shown in FIG. 11, the resilient region may be L-shaped and its elastic leg may extend to the opposite direction as shown in FIG. 3. This may be necessary in case other components of the clock having to be arranged on this side of the opening 33.

The bedplate 32 may be manufactured by stamping to the configuration shown in FIG. 11.

The rear plate 31 which may serve as bell of an alarm clock is provided with three parallel hook shaped elements 33′, 35′ and 36′ which have been formed the same way as the elements 12, 14 and 24 in FIG. 8.

Latch projection 37, 38, 39 and extensions 40, 41 and 42 are provided. The hook shaped elements 33′, 35′ and 36′ engage the holes 33, 35, 36 of rear bedplate 32.

Figure 14:
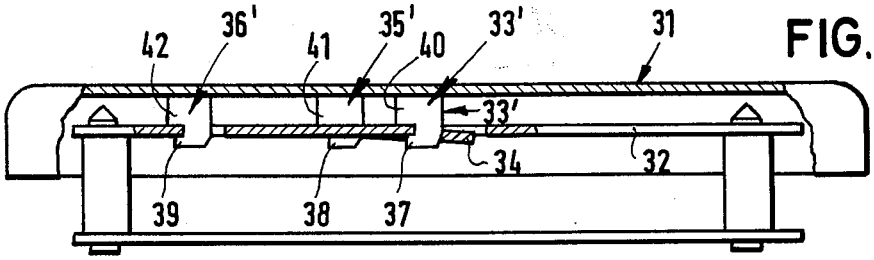
FIGS. 12 to 14 are partial sectional views taken on line XI—XI of FIG. 11 of the bedplate shown in FIG. 11 together with the bell, prior to, during, and after completed connection.
Figure 13:
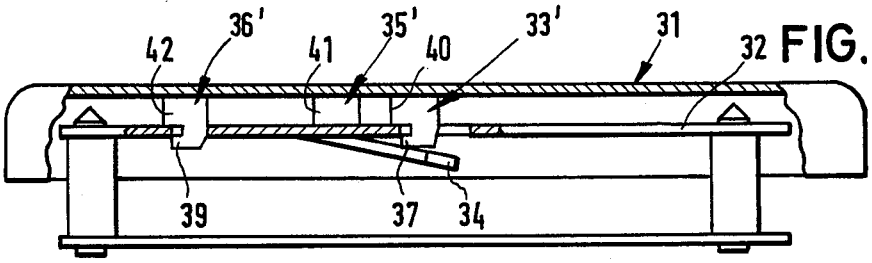
Figure 12:
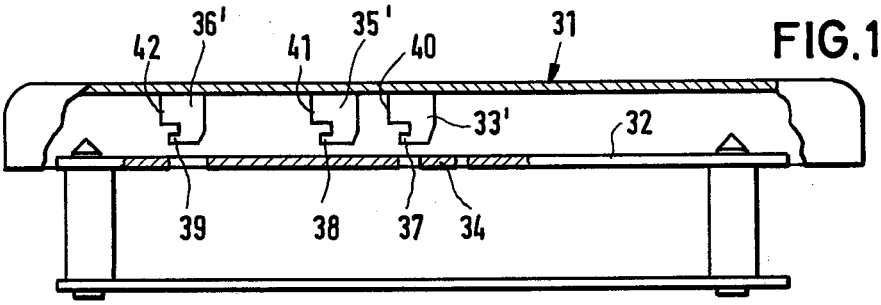

To connect the rear plate or bell 31 with the rear bedplate 32 the bell 31 is placed on the bedplate 32 and pressed down as shown in FIG. 13 thereby deflecting the leg 34. Then the bell 31 is pushed to the left to engage the hooks with the bedplate 32 and to permit the leg 34 to catch and lock the element 33′, as shown in FIG. 14.

While there have been illustrated and described several embodiments of the present invention as well as methods of making the parts which comprise the invention, it will be understood that various changes and modifications may occur to those skilled in the art. It is intended to cover all modifications and equivalents within the scope of the appended claims.

What is claimed is:

1. A device for connecting a first part with a second part, wherein said first part defines a first plane, and wherein said second part defines a second plane, comprising at least one opening provided in said first part and located in said first plane, said opening being defined by flat wall portions of said first part, at least one locking element projecting from said second part, said projecting locking element having a stem extending substantially at right angles to said second plane and an end portion extending from said stem, said stem and end portion being adapted to be received in said opening for releasably engaging said flat wall portions by a sliding movement parallel to said flat wall portions, said device further comprising a resilient latch member normally located in said first plane defined by said first part, said resilient latch member being adapted to be deflected out of said first plane by said end portion of said projecting locking element into a first position allowing said end portion to be introduced into said opening and to engage said flat wall portions, said resilient latch member resiliently moving back into a second position in abutting relationship with said projecting locking element so as to maintain said stem and end portion of the projecting locking element engaged with said flat wall portions, whereby a rigid locking but a resilient disengagement is provided.

2. A device as in claim 1, wherein said projecting locking element and said opening have the same width perpendicular to said end portion.

3. A device as in claim 1, wherein said projecting locking element has a base wider than said opening.

4. A device as in claim 1, wherein said projecting locking element of the second part comprises a spacing between its end portion and the adjacent surface of the second part carrying the projecting locking element, said spacing being equal to the thickness of the first part adjacent to said opening.

5. A device as in claim 1, wherein the end portion of the projecting locking element has a sufficient length to serve as support for the first part.

6. A device as in claim 1, wherein said projecting locking element is formed integrally with the second part.

7. A device as in claim 1, wherein the projecting locking element comprises a stamped out tongue forming said stem and a bent portion at the end of the tongue forming said end portion.

8. A device as in claim 1, comprising a second projecting locking element located at a certain distance from the first projecting locking element and a second opening located to face the second element.

9. A device as in claim 1, wherein one of said parts is the casing of a clock.

10. A device as in claim 1, wherein one of said parts is a base plate.

11. A device as in claim 1, wherein one or both of said parts of the device are made of plastics material.

12. A device as in claim 1, wherein said stem of said projecting locking element has a slanted surface opposite said end portion of said projecting locking element, said slanted surface slanting in such a direction that in the locked position said resilient latch member tends to ride up on said slanted surface at least partially toward a position in said first plane, and whereby the two parts may be separated again when said resilient latching member rides down on and off said slanted surface.

13. A device as in claim 8, further comprising a third projecting locking element located at a distance from the first and the second projecting locking element and a third opening facing the third projecting locking element.

14. A device as in claim 13, wherein the second and third projecting locking elements have the same direction and shape as the first element.

15. A device as in claim 9, wherein the other of said parts is a figurine to be mounted on the clock.

16. A device as in claim 10, wherein the other of said parts is a bed plate.

* * * * *

UNITED STATES PATENT OFFICE

CERTIFICATE OF CORRECTION

Patent No. 3,979,900 Dated September 14, 1976

Inventor(s) Helmut Doerflinger, Erich Ropertz, Bruno Ruf

It is certified that error appears in the above-identified patent and that said Letters Patent are hereby corrected as shown below:

[30] Foreign Application Priority Data

| | | |
|---|---|---|
| Feb. 28, 1974 | Germany | 7407049[U] |
| Mar. 14, 1974 | Germany | 7408983[U] |

Signed and Sealed this

Thirtieth Day of November 1976

[SEAL]

*Attest:*

RUTH C. MASON
*Attesting Officer*

C. MARSHALL DANN
*Commissioner of Patents and Trademarks*